United States Patent [19]

Walker

[11] Patent Number: 4,724,807

[45] Date of Patent: Feb. 16, 1988

[54] IN-LINE AIR-OIL SEPARATOR

[76] Inventor: Robert A. Walker, 7335 Havenhurst, Van Nuys, Calif. 91406

[21] Appl. No.: 843,112

[22] Filed: Mar. 24, 1986

[51] Int. Cl.[4] ..... F01M 1/00

[52] U.S. Cl. ..... 123/196 A; 55/461

[58] Field of Search ..... 123/196 R, 196 A, 572; 55/461, 458, 459

[56] References Cited

U.S. PATENT DOCUMENTS

| | | | |
|---|---|---|---|
| 3,789,582 | 2/1974 | Graybill | 55/461 |
| 3,822,532 | 7/1974 | Weisgerber | 55/461 |
| 4,047,912 | 9/1977 | Markland | 55/461 |
| 4,095,966 | 6/1978 | Isley | 55/461 |
| 4,401,093 | 8/1983 | Gates, Jr. et al. | 123/572 |
| 4,404,950 | 9/1983 | Dallman | 123/572 |
| 4,409,950 | 10/1983 | Goldberg | 123/572 |
| 4,585,466 | 4/1986 | Syred et al. | 55/461 |

*Primary Examiner*—E. Rollins Cross

*Attorney, Agent, or Firm*—Christie, Parker & Hale

[57] ABSTRACT

The filtering apparatus filters air-contaminant mixtures. An annular housing has an outer wall and a channel defining a central axis, the channel having a primary gas inlet and a primary gas outlet and a channel wall. The apparatus has a secondary inlet port passing through the outer wall. A secondary outlet port defines an opening in the channel wall such that there is no straight line flow path between the secondary inlet and the secondary outlet. A passageway between the secondary inlet and the secondary outlet is defined exteriorly by the outer wall and interiorly by the channel wall.

19 Claims, 5 Drawing Figures

IN-LINE AIR-OIL SEPARATOR

BACKGROUND OF THE INVENTION

1. Field of the Invention

The present invention relates to air-oil separators, more specifically to a separator for separating oil from contaminated air wherein the separator is placed in-line with a flow line.

2. Related Art

Prior U.S. Pat. Nos. 3,721,069 and 4,184,858 relate to air-oil separators. The specifications and claims of these patents are incorporated herein by reference. In the first patent, the separator uses a baffle for producing primary separation of oil from the air-oil mixture and causes the mixture to be driven through filtration material. The oil separated from the mixture then drops to a reservoir for return back to the engine crankcase, oil pump, etc. The greater cross sectional area of the outlet conduit relative to the inlet port is a significant part of the prior device and provides a means whereby the pressure of the mixture or vapor introduced into the device can be reduced to near atmospheric pressure, contributing significantly to the action of the device. In the second patent, the filtering material is coated with a fluid to assist in removal of the oil from the mixture. The filtered air output of the separator may be passed to the clean air intake of the engine.

SUMMARY OF THE INVENTION

A filtering apparatus filters air-contaminant mixtures. The apparatus includes an annular housing having an outer wall and a channel in the housing defining a central axis. The channel has a primary gas inlet and a primary gas outlet and a channel wall. The apparatus has a secondary inlet port through the outer wall and a secondary outlet port defining an opening in the channel wall. The secondary outlet is formed such that there is no straight line flow path between the secondary inlet and the secondary outlet. A passageway between the secondary inlet and the secondary outlet is defined exteriorly by the outer wall and interiorly by the channel wall.

In one form of the invention, the filtering apparatus is placed so that the channel is in-line with the air cleaner/silencer and the induction system for heavy engines such as Detroit diesels. The induction system may include a clean air turbine. The secondary inlet is coupled with a vacuum limiter to the engine breather for the crankcase. The primary inlet is coupled to the air cleaner and the primary outlet is coupled to the induction turbo. An oil drain plug is provided for returning the filtered oil to the engine block.

The apparatus may include one or more baffles for forming condensation/precipitation or adsorption surfaces for removing the oil from the air-contaminant mixture. Where there is only one baffle, the secondary inlet and the secondary outlet are oriented on a side of the apparatus opposite the side of the apparatus where an opening in the baffle occurs. Where there are two baffles, the secondary inlet is located on a side of the housing opposite the side where an opening in the first baffle is placed and on the same side of the housing as an opening in the second baffle. The secondary outlet is located on a side of the housing substantially opposite the secondary inlet.

DETAILED DESCRIPTION OF THE PREFERRED EMBODIMENTS

Figure 1:
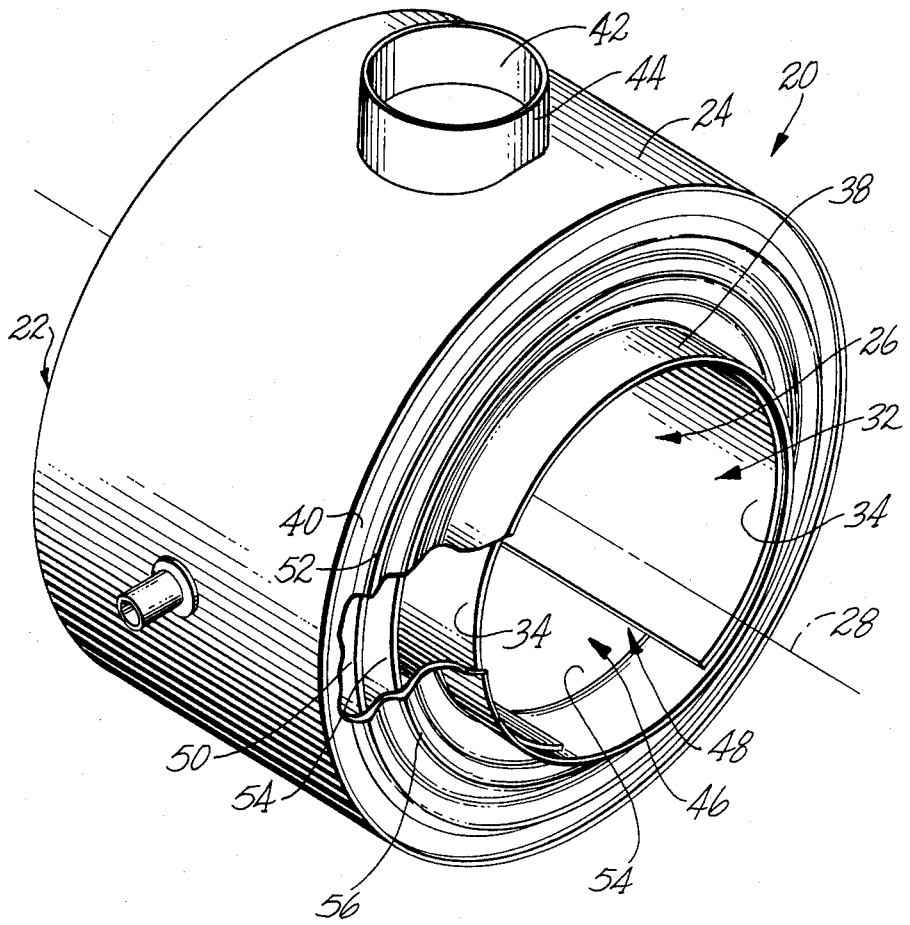
FIG. 1 shows a perspective and partial cutaway of a schematic of a filtering apparatus embodying the present invention.

FIG. 1 shows a filtering apparatus 20 for filtering contaminants from pressurized air-contaminant mixtures. Contaminants may include oil and other heavy hydrocarbons, etc. The apparatus is formed from an annular housing 22 having an outer wall 24. The outer wall may be formed from sheet metal or other material suitable for withstanding the temperature and environment associated with internal combustion engines. The strip of sheet metal may be formed into a cylinder and fastened at the joined ends by rivets or may be held together by clamps, etc.

A channel 26 forms the central portion of the annular housing and defines an axis 28 about which the housing is substantially symmetrical. The channel has a primary gas inlet 30 (FIG. 4) for coupling to a clean air intake or air cleaner/silencer, for example, and a primary gas outlet 32 coupled to an air induction system for an engine, for example. The channel has a channel wall 34 preferably formed from the same material from which the outer wall 24 was formed. The channel wall extends along axis 28 a distance greater than the length of the outer wall 24 forming an inlet flange (not shown) and an outlet flange 38 for coupling to respective hoses or ducts for conducting the primary air flow and for allowing continuous flow therebetween. The inlet flange is substantially the same as but oppositely facing relative to the outlet flange. The flow is clean air flow from the air cleaner/silencer to the air induction turbo.

The outer wall and the channel are maintained in spaced apart relation with respect to each other through a pair of convoluted end surfaces 40. Only the convoluted end surface on the downstream end of the apparatus is shown in the drawings. The terms "upstream" and "downstream" as used herein refer to axial positions relative to a midpoint on axis 28. The downstream convoluted end surface is riveted or otherwise fastened to the downstream end of the channel wall at the outlet flange 38. The remainder of the end surface extends radially outward from the outlet flange 38 to the outer wall 24. At the other wall, the end surface then bends inwardly to conform to the inner surface of the outer wall. The in-turned portion of the end surface may then be spot welded or riveted to the outer wall. Alternatively, the portion of the end surface abutting the outer wall may be turned outward in the same direction as the outlet flange and spot welded or riveted to the outer wall. The portion of the convoluted end surface contacting the channel wall may also be spot welded to form an airtight seal. The upstream convoluted end surface, not shown in FIG. 1, is substantially identical but oppositely facing relative to the downstream convoluted end surface and is placed on the side of the housing opposite the downstream end surface and mounted in an identical fashion.

In an alternative to the external housing design, the outer wall may be omitted as a separate piece. The in-turned portions of the convoluted end surfaces are then formed to extend completely to the axial center of the housing to be joined to the respective opposite in-turned portion by welding or by other suitable means. The result would be a seam extending about the center of the circumference of the housing. Additionally, all junctions may be sealed with a sealer such as a suitable silicone sealer. As a result, the annular housing forms an airtight enclosure, except as described below.

A secondary inlet port 42 extends through the outer wall 24 along a flange 44 which is preferably riveted or spot welded to the outer wall. The secondary inlet provides fluid flow to the interior of the annular housing. The secondary inlet is adapted to be coupled to a breather connection to an internal combustion engine as described more fully below.

The annular housing further includes a secondary outlet port 46 opening into the channel 26. The secondary outlet defines an opening 48 in the channel wall 34. The secondary outlet is formed in the housing in such a way that there is not straight line flow path between the secondary inlet and the secondary outlet. In the apparatus shown in FIG. 1, the remainder of the channel wall is interposed between the secondary inlet and the secondary outlet so that any incoming fluid such as crankcase air must follow a semicircular path around the inside surface of the channel wall in order to reach the secondary outlet.

The interior of the housing defines a passageway for fluid flow between the secondary inlet and the secondary outlet. The passageway is defined at the outermost extreme by the inside surface of the outer wall 24 and at the innermost extreme by the inside surface of the channel wall 34. As will be discussed more fully below, a first baffle 50 is positioned in the housing between the outer wall and the channel wall and spaced from each. The upstream and downstream edges of the first baffle extend into respective convolutions in the upstream and downstream convoluted surfaces. As shown in FIG. 1, the first baffle contacts a first convolution 52 formed as a ridge extending away from the interior of the housing. The edge of the baffle contacts the inside vertex formed by the ridge. In the preferred embodiment, the edges of the first baffle are sealed in the vertex with a silicone sealer for preventing passage of the crankcase air between the baffle and the convoluted surface.

A second baffle 54 is positioned between the first baffle and the channel wall 34. The second baffle includes upstream and downstream edges similar to those of the first baffle and fit into a second convolution 56 and is sealed thereto with silicone sealer. The outer wall, the baffles and the channel wall are preferably concentric.

A drain coupling 58 is preferably centrally mounted between the edges of the outer wall 24 to allow oil to drain from the interior of the annular housing. A hose or other similar conduit may be attached to the coupling for feeding the oil to an engine block. The circumferential location of the coupling with respect to the secondary inlet 42 will be determined by the final orientation of the housing with respect to the engine. Once the final orientation is determined, the drain coupling is mounted to the outer wall at the bottom of the housing so that the oil enters the coupling through force of gravity. However, for any given engine design, the position of the coupling will be the same.

In the remaining Figures, identical elements are identically numbered and have the same structure and function as described above. Additional elements will now be described.

Figure 2:
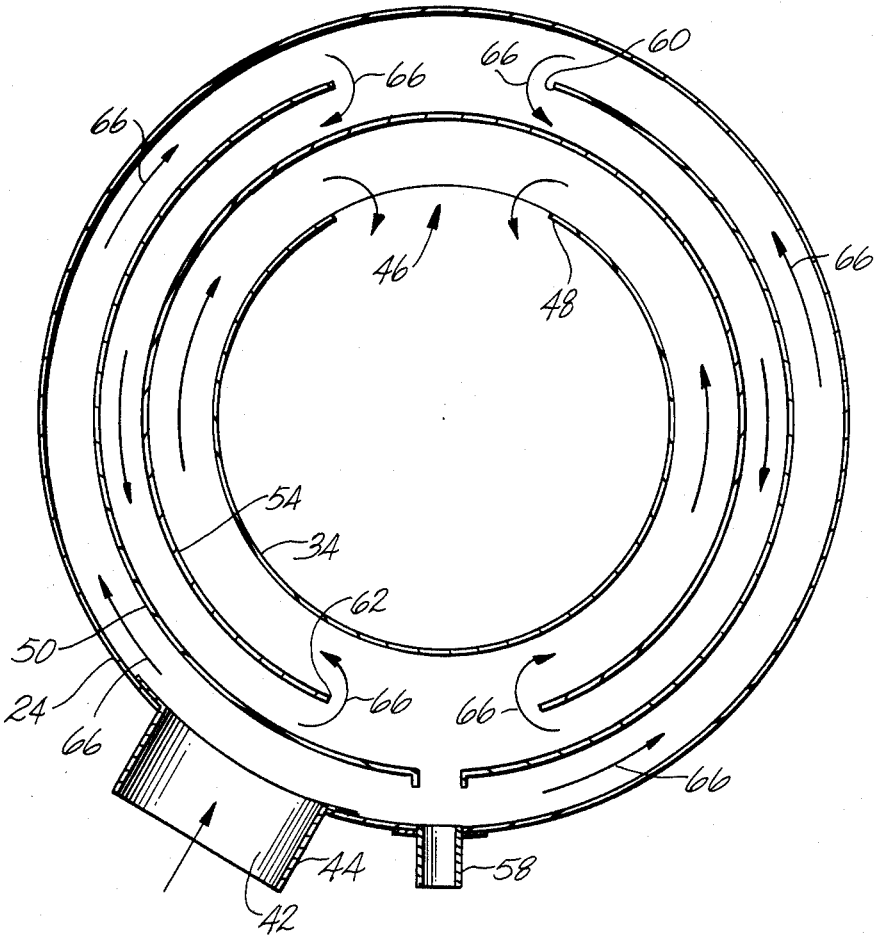
FIG. 2 is a schematic and vertical cross-section of the apparatus of FIG. 1.

In FIG. 2, the two-baffle apparatus can be considered a three-baffle arrangement wherein the channel wall 34 acts as the third baffle. In the orientation shown in FIG. 2, the inlet 42 is oriented on a side of the apparatus substantially opposite the location of a first baffle opening 60. The second baffle 54 has a second baffle opening 62 on a side of the housing substantially opposite that of the first baffle opening. The secondary inlet 46 is then oriented on a side of the housing substantially opposite that of the second baffle opening. This arrangement of openings is preferred since any oil condensing or adsorbing onto the interior surface of the outer wall 24 or on the outwardly facing surface of the first baffle would drain down those surfaces to the drain coupling 58. Similarly, any oil contacting the inwardly facing surface of the first baffle or the outwardly facing surface of the second baffle would drain downwardly to the lowermost point on the inwardly facing surface of the first baffle. A drain is provided for the first baffle with various designs. For example, one or more simple 3/16 inch openings may be drilled in the first baffle to allow draining of the oil down to the drain coupling 58. Preferably, the first and second baffle openings extend axially from the upstream convoluted surface to the downstream convoluted end surface.

Figure 3:
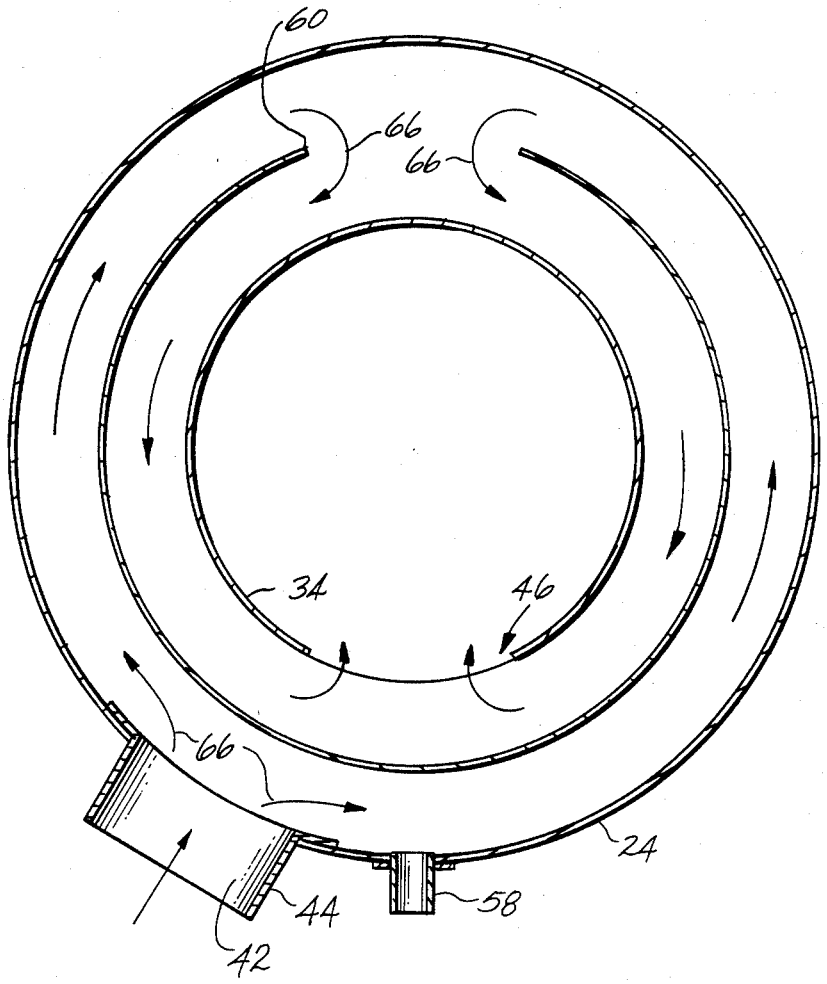
FIG. 3 is a schematic and vertical cross-section of an apparatus similar to that of FIG. 1 showing a single baffle.

FIG. 3 shows a single baffle arrangement wherein the secondary inlet 42 is oriented near the physical bottom of the apparatus. The drain 58 is located at the bottom of the apparatus. The single baffle fits into a single convolution on respective convoluted end surfaces. In the embodiment shown in FIG. 3 the first baffle opening 60 is located on a side of the housing substantially opposite that of the secondary inlet and the secondary outlet is located on a side of the housing substantially opposite that of the first baffle opening. The flow between the secondary inlet and the secondary outlet is indicated by the arrows 66 in FIGS. 2 and 3. As can be seen, the baffles in the respective embodiments define respective passageways along which the air-contaminant mixture must pass before reaching the secondary outlet.

In the preferred embodiment, the secondary inlet has a diameter of two inches. The secondary outlet has an arcuate opening distance of two inches and an axial opening distance of five inches. The inside diameter of the channel is preferably five inches, the diameter of the first baffle six and one-half inches, the diameter of the second baffle eight inches and the diameter of the outer wall 24 nine and one-half inches. The length of the flange 38 is preferably one and one-eighth inches, the distance between the flange and the first convolution in the two-baffle arrangement is three-quarters of an inch, the distance between the first convolution and the second convolution is one-half inch and the distance between the second convolution and the outer wall is one-half inch. The height of the convolutions is preferably one-quarter inch. In the single-baffle arrangement, the first baffle is seven inches in diameter and the outer wall has a diameter of eight and one-half inches. The distance between the outlet flange 38 and the first convolution is one inch.

Figure 4:
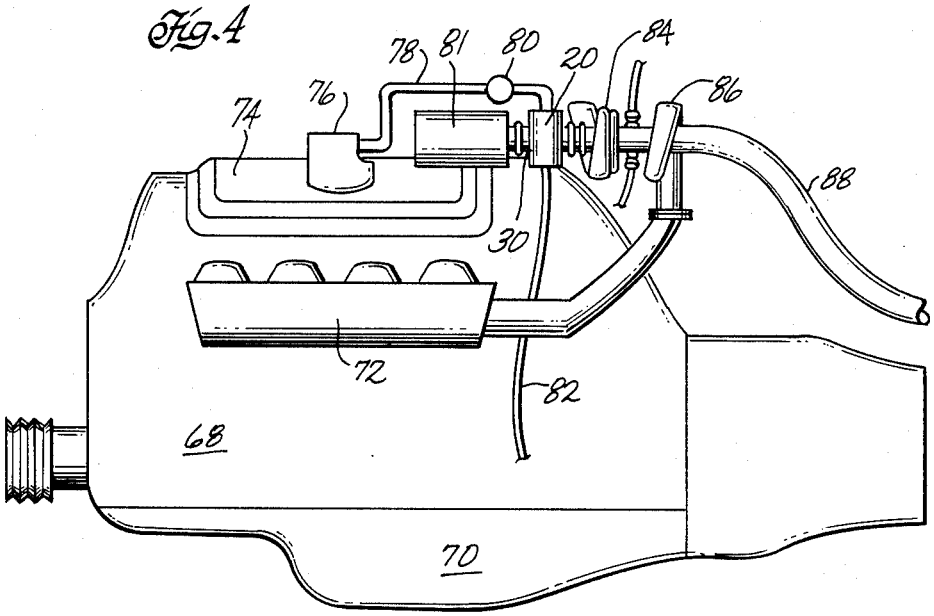
FIG. 4 shows a schematic and side elevation view of an engine incorporating the filtering apparatus shown in FIG. 1.

FIG. 4 shows an engine block 68 including an oil reservoir 70, an exhaust manifold 72 and a valve cover 74. The engine breather is coupled through a hose 78 with a vacuum limiter 80 to the filtering apparatus 20. The oil from the drain coupling on the filtering apparatus passes through an oil line 82 to the oil reservoir. The inlet flange 30 of the filtering apparatus is coupled to the clean air filter and silencer 81. The outlet flange of the filtering apparatus 20 is coupled to an intake air turbo 84. The exhaust manifold 72 is coupled to an exhaust turbo 86, which in turn is coupled to the exhaust 88. Alternatively, engines without turbos have the primary outlet of the filtering apparatus coupled to the induction system for the engine. Generally, the filtering apparatus can be adapted to the crankcase and clean air intake systems of any internal combustion engine.

Figure 5:
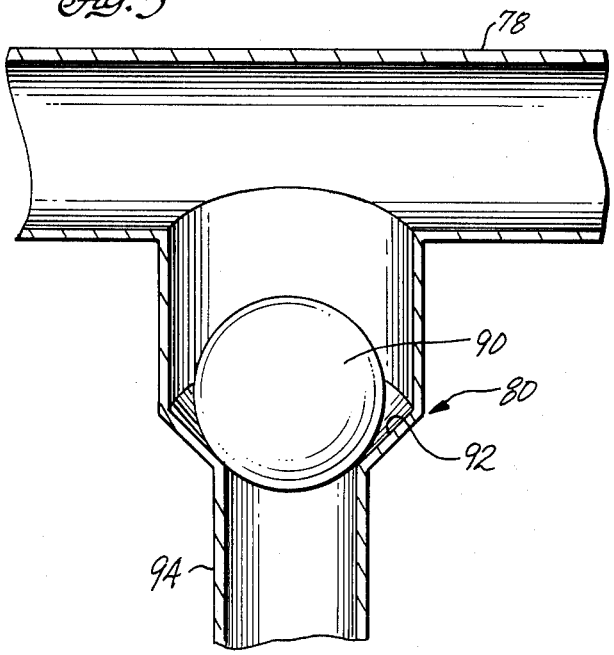
FIG. 5 is a schematic side-sectional view of a vacuum limiter used between the engine breather of the engine shown in FIG. 4 and the input of the filtering apparatus.

FIG. 5 shows a detail of the hose 78 and vacuum limiter 80. The vacuum limiter is coupled to a bottom portion of the hose, through welding or a hose and clamp. The vacuum limiter includes a ball 90, such as a one inch diameter steel ball, for seating in seat 92 to close off an air tube 94 open to the ambient air through an air filter (not shown). The air filter fits over the entire vacuum limiter up to the hose 78. If after fitting the filtering apparatus to the engine it is found that the vacuum in the hose 78 is still too high as determined by an appropriate pressure sensor, one or more holes (not shown) can be drilled in the vertical cylindrical portion of the limiter between the seat 92 and the hose 78 to allow pulling of ambient air into the hose. Alternatively, an adjustable valve may be placed in the vacuum limiter as a substitute for holes.

The filtering apparatus 20 is preferably oriented so that the axis 28 is oriented on the center line of the air cleaner and silencer, and of the turbo of engines equipped with such.

Consider now the operation of the apparatus. With the connections formed as shown in FIG. 4, the intake air turbo creates a vacuum for pulling air into the air filter and silencer. The air is pulled through the air filter and silencer 81 and through the channel 26 in the filtering apparatus. (The same effect is produced without a turbo when the primary outlet of the filtering apparatus is coupled to the induction system of the engine.) The effect of the turbo produces a pressure differential between the secondary outlet 46 and the secondary inlet 42 so that contaminated air flows from the engine breather 76 through the hose 78 past the vacuum limiter 80. The contaminated air is introduced into the inlet 42 so that the air strikes the first baffle 50. The oil-contaminated air passes through the passageways along the flow lines indicated by the arrows 66. The oil in the contaminated air impacts and condenses or is adsorbed on the interior surface of the outer wall and the exterior surface of the first baffle. This process continues as the contaminated air flows about the first baffle, and about the second baffle if the filtering apparatus includes a second baffle, until the air exits the secondary outlet and enters the channel. The filtered air then continues along the channel to the intake air turbo, which then transports the air as usual. The pressure differential between the secondary inlet and the secondary outlet is assisted by the difference in cross-sectional area of the breather port and the secondary outlet. The ratio of the cross-sectional area of the breather port to the cross-sectional area of the secondary outlet may be about 12%, but may have a range of values depending on the type of engine, etc. The values may range from 8% to 25% but no outside limit for the range has been defined.

Alternatively, all the pressure drop may occur within the apparatus itself by making the diameter of the secondary inlet the same as the diameter of the breather port. Then the range of cross sectional areas are maintained or adjusted by considering the diameter of secondary inlet rather than that of the breather port. The filtering apparatus may be designed for any type of engine, as long as the ratio of breather port to outlet area is maintained in the desired range for a given efficiency or throughput. The efficiency of the filtering apparatus may be changed by varying the diameter of the apparatus, i.e. increasing the surface area of the baffles and interior surfaces in the housing and increasing the cross-sectional area of the flow path, or increasing the axial length of the annular housing, with the same result. The throughput may be changed by changing the breather port or the secondary inlet and outlet cross-sectional areas.

The presence of oil droplets or particles in the air in the crankcase is due partly to the relatively high pressure in the crankcase. By removing air through the breather, the pressure in the crankcase is decreased somewhat. This serves to also decrease the amount of oil entrained in the crankcase air. However, as will be discussed below, it is significant that the pressure difference between the crankcase and the filtering apparatus not be too large. Otherwise, a relatively large amount of oil and oil laiden air will be pulled from the crankcase. For example, if the air cleaner/silencer becomes clogged for any reason, the suction created by the turbo or the induction system would increase the pressure difference between the breather and the filtering apparatus. The vacuum limiter described below prevents the occurrence of too large of a pressure differential.

The vacuum limiter limits the intake of contaminated air from the breather. If the vacuum developed by the turbo increases beyond a given point determined by the weight of the ball 90, air is pulled in from the air tube 94 into the hose 78. This prevents sucking of oil and the contaminated air from the crankcase more than is desirable. The diameter of the air tube 94 is preferably three-quarters of an inch, the length of the air tube is also preferably three-quarters of an inch. The height of the conical portion of the vacuum limiter is preferably one-half inch. However, the airpassage between the breather and the vacuum should be airtight except for the drilled holes or adjustable valve described above so that the vacuum limiter can operate as designed.

The cross-sectional area of the passageways in the interior of the filtering apparatus is preferably greater than or approximately equal to the cross-sectional area of the secondary outlet. This maintains a low flow velocity to the passageways.

The in-line arrangement of the filtering apparatus provides for a pressure differential between the breather and the channel 26 for transferring the contaminated air from the breather. The design requires little modification of the air intake design of current engines and is simple and economical to assemble. Significantly, the in-line design with the filtered air being supplied to the induction system and the oil being returned to the oil system produces an essentially closed crankcase ventilation system. The system conserves oil, returns lighter unburned hydrocarbons to the induction system, reduces crankcase pressure, increases fuel efficiency and engine lifetime. Filter material may be used in the passageways but is not necessary.

It should be noted that the above are preferred configurations, but others are foreseeable. The described embodiments of the invention are only considered to be preferred and illustrative of the inventive concepts. The scope of the invention is not to be restricted to such embodiments. Various and numerous other arrangements may be devised by one skilled in the art without departing from the spirit and scope of the invention. For example, there may be cases where zero, three or four baffles are appropriate.

What is claimed is:

1. A filtering apparatus for air-contaminate mixtures, the apparatus comprising:

an annular housing having an outer wall;

a channel in the housing defining a central axis, having a primary gas inlet and a primary gas outlet and having a channel wall;

a secondary inlet port through the outer wall;

a secondary outlet port defining an opening in the channel wall such that there is no straight line flow path between the secondary inlet and the secondary outlet; and a passageway between the secondary inlet and the secondary outlet defined exteriorly by the outer wall and interiorly by the channel wall.

2. The apparatus as claimed in claim 1 further comprising a baffle between the outer wall and the channel wall.

3. The apparatus as claimed in claim 2 wherein the baffle comprises an opening on a side of the housing substantially opposite the secondary inlet for passage of air toward the secondary outlet.

4. The apparatus as claimed in claim 3 wherein the secondary outlet port is positioned in the channel wall on a side of the housing substantially the same as the secondary inlet.

5. The apparatus as claimed in claim 2 further comprising a second baffle between the first described baffle and the channel wall.

6. The apparatus as claimed in claim 5 wherein the first described baffle comprises an opening on a side of the housing substantially opposite the secondary inlet and the second baffle comprises an opening on a side of the housing substantially opposite the opening in the first baffle.

7. The apparatus as claimed in claim 6 wherein the secondary outlet is positioned in the channel wall on a side of the housing substantially opposite the secondary inlet.

8. The apparatus as claimed in claim 1 wherein the channel comprises an exhaust line.

9. The apparatus as claimed in 8 wherein the primary gas inlet is adapted to be coupled to an air cleaner and the primary gas outlet is adapted to be coupled to an induction system.

10. The apparatus as claimed in claim 1 further comprising a vacuum limiter in a flow line coupled to the secondary inlet.

11. The apparatus as claimed in claim 1 further comprising a drain coupled to the housing for eliminating a contaminant from the housing.

12. An internal combustion engine comprising:

an engine block with an engine breather having an outlet;

an air filter;

a filtering apparatus comprising:

an annular housing having an outer wall, a channel in the housing defining a central axis, having a primary air inlet coupled to the air filter and a primary air outlet and having a channel wall, a secondary inlet port through the outer wall coupled to the breather outlet, a secondary outlet port defining an opening in the channel wall such that there is no straight line flow path between the secondary inlet and the secondary outlet, and a passageway between the secondary outlet and the secondary outlet defined exteriorly by the outer wall and interiorly by the channel wall; and an induction system coupled to the primary air inlet for producing flow of air through the channel.

13. The engine as claimed in claim 12 further comprising a vacuum limiter coupled between the breather and the secondary inlet for limiting a vacuum created between the breather and the secondary inlet.

14. The engine as claimed in claim 13 wherein the vacuum limiter comprises a movable plug and a seat for the plug wherein the plug is drawn into the seat by gravity.

15. The engine as claimed in claim 12 further comprising a return line between the filtering apparatus and the engine block for returning oil separated in the filtering apparatus to the engine block.

16. The apparatus as claimed in claim 1 wherein the secondary inlet and the secondary outlet each comprise respective cross sectional areas and wherein the cross sectional area of the secondary inlet is less than the cross sectional area of the secondary outlet.

17. The apparatus as claimed in claim 16 wherein the breather outlet comprises a cross sectional area and a ratio of the cross sectional area of the breather outlet to the cross sectional area of the secondary outlet is approximately 0.15.

18. The apparatus claimed in claim 15 wherein the return line and the primary air outlet comprise the only outlet for flow from the breather.

19. The apparatus as claimed in claim 12 further comprising an oil return line to the engine block from the filtering apparatus and wherein the filtering apparatus, the induction system and the oil return line comprise a closed crankcase ventilation system.

* * * * *